US008568216B2

(12) United States Patent
Decre et al.

(10) Patent No.: US 8,568,216 B2
(45) Date of Patent: Oct. 29, 2013

(54) PAWN WITH TRIGGERABLE SUB PARTS

(75) Inventors: Michel Marcel Jose Decre, Eindhoven (NL); Anthonie Hendrik Bergman, Eindhoven (NL); Hubertus Maria Rene Cortenraad, Maastricht (NL)

(73) Assignee: Koninklijke Philips N.V., Eindhoven (NL)

( * ) Notice: Subject to any disclaimer, the term of this patent is extended or adjusted under 35 U.S.C. 154(b) by 1591 days.

(21) Appl. No.: 11/815,017

(22) PCT Filed: Jan. 27, 2006

(86) PCT No.: PCT/IB2006/050300

§ 371 (c)(1),
(2), (4) Date: Jul. 30, 2007

(87) PCT Pub. No.: WO2006/082547

PCT Pub. Date: Aug. 10, 2006

(65) Prior Publication Data

US 2008/0161086 A1 Jul. 3, 2008

(30) Foreign Application Priority Data

Feb. 2, 2005 (EP) ..... 05100700

(51) Int. Cl.
*A63F 9/24* (2006.01)

(52) U.S. Cl.
USPC ..... 463/14; 463/1; 463/39

(58) Field of Classification Search
None
See application file for complete search history.

(56) References Cited

U.S. PATENT DOCUMENTS

| | | | | | |
|---|---|---|---|---|---|
| 680,746 | A | | 8/1901 | Tremblay | |
| 3,893,671 | A | * | 7/1975 | Gardner | 273/238 |
| 4,391,447 | A | * | 7/1983 | Dudley | 273/238 |
| 4,545,582 | A | | 10/1985 | Andrews | |
| 5,082,286 | A | * | 1/1992 | Ryan et al. | 273/238 |
| 5,188,368 | A | | 2/1993 | Ryan | |
| 5,190,285 | A | * | 3/1993 | Levy et al. | 463/36 |
| 5,462,281 | A | * | 10/1995 | Gaito et al. | 273/238 |
| 5,853,327 | A | * | 12/1998 | Gilboa | 463/39 |
| 6,443,796 | B1 | | 9/2002 | Shackelford | |
| 6,835,131 | B1 | * | 12/2004 | White et al. | 463/1 |
| 7,050,754 | B1 | * | 5/2006 | Marcus et al. | 434/362 |

FOREIGN PATENT DOCUMENTS

| | | |
|---|---|---|
| DE | 29611937 | 11/1996 |
| EP | 0360624 | 3/1990 |
| WO | 0115059 | 3/2001 |
| WO | 0221432 | 3/2002 |
| WO | 2006033037 | 3/2006 |

* cited by examiner

*Primary Examiner* — Paul A D'Agostino

(57) ABSTRACT

A pawn (10) for use on a board (21) is provided. The pawn (10) is arranged to provide a trigger signal upon a touch of a triggerable part of the pawn (10) by a user, and comprises communication means for communicating the trigger signal to a board (21). The pawn (10) comprises at least two separate triggerable sub-parts (11, 12) for, upon a touch of each respective one of the at least two separate triggerable sub-parts (11, 12) by a user, respectively providing a first and a second trigger signal. The first and the second trigger signal are mutually distinguishable. Such a pawn (10) can easily be used for activating a certain function of a set of functions. A function is selected by touching a corresponding triggerable sub-part (11, 12).

12 Claims, 7 Drawing Sheets

PAWN WITH TRIGGERABLE SUB PARTS

The invention relates to a pawn for use on a board. The pawn is arranged to provide a trigger signal upon a touch of a triggerable part of the pawn by a user, and comprises communication means for communicating the trigger signal to a board.

The invention further relates to a system which comprises a board and at least one of such pawn. The board comprises receiving means for receiving the trigger signal, and a processor for changing a situation in response to the trigger signal.

Such a pawn is used in a commercially available board game, named 'King Arthur' (http://www.kingarthur.de) which is sold by Ravensburger. In this game, a player can choose a particular action out of a range of actions to be performed by a knight which is represented by a knight shaped pawn. When a player touches the helmet of the knight, the touch is detected and communicated to the game board via a sensitive contact surface which is in contact with the game board. A set of distinctive action fields is provided on the board surface of the game board. Each one of the action fields corresponds to a different action. A player instructs the knight to perform a certain action by simultaneously touching the helmet with one or more fingers of one hand and the action field which corresponds to the desired action with one or more fingers of the other hand.

It is a disadvantage of the known technique that a user has to perform a complex and not very intuitive action for activating a certain function of a set of functions.

It is an object of the invention to provide a pawn as described in the opening paragraph, which can easily be used for activating a certain function of a set of functions.

According to the invention this object is achieved by providing a pawn as described in the opening paragraph, wherein the pawn further comprises at least two separate triggerable sub-parts for, upon a touch of each respective one of the at least two separate triggerable sub-parts by a user, respectively providing a first and a second trigger signal, the first and the second trigger signal being mutually distinguishable, and communication means for communicating the first and the second trigger signal to the board.

Because the trigger signals which correspond to the touching of different triggerable sub parts are mutually distinguishable, the touching of different sub parts may activate different functions. A user can activate a certain function by simply touching the corresponding sub-part. Each sub-part corresponds to a different trigger signal. A trigger signal corresponding to the touched sub-part is communicated to the board. The trigger signal enables the board to change the situation according to the function selected by the user.

In a preferred embodiment the first and the second trigger signal are electrical signals. It is an advantage of the usage of electric signals that electric signal are easy to transfer or process.

In an embodiment the pawn comprises a support surface for supporting the pawn on a board surface of the board and the communication means comprises at least one electrode, extending from an electrode contact at the support surface to one of the triggerable sub-parts for, upon the touch of said triggerable sub-part, conducting the corresponding electrical signal between said one of the triggerable sub-parts and the board surface.

When a user touches the triggerable sub part of the pawn, an electrical charge on the board surface will change via the electrode contact, the electrode and the user. The position of the support surface relative to the board surface and the position of the electrode contact relative to the support surface, determine at which part of the board surface the electrical charge changes when a sub-part is touched. From the local change of the charge at this specific part of the board surface, it can be determined which sub-part has been touched.

It is an advantage of such a pawn that it can be used in combination with a capacitive touch screen. The use of the display of a touch screen as a board surface of a game board is, for example, known from the non-pre-published European Patent Application having application number EP04104563.4 wherein the touch screen is used for determining a position of the pawns on the board surface.

In the International Patent Application WO 02/21432 a pawn is described which comprises electrical coupling means for electrically coupling the pawn to a resistive sensing surface of a game board. The game board comprises a plurality of electrodes, which are electrically coupled to the resistive sensing surface. When a pawn is placed on the sensing surface a player touching the pawn is electrically coupled to the electrodes via the resistive surface. When a signal is provided to the electrodes, a return path to ground is provided via the pawn and the player. The location of the pawn is derived from the return signal. A game board as described in WO 02/21432 may be used with the pawn according to the invention. WO 02/21432 does not disclose the use of different separate triggerable sub-parts.

In a further improved embodiment, the electrode contacts at the support surface form a geometrical pattern for identifying the pawn. If all pawns, placed on a board, have unique geometrical patterns of electrode contacts, the position and the identity of each pawn can be determined when the user simultaneously or sequentially touches all triggerable sub-parts of the pawn. When all sub-parts are touched, all electrode contacts of the pattern communicate a trigger signal to the board. From the positions of the electrode contacts relative to each other the pattern and thus the identity of the pawn is derived. From the position of the electrode contacts relative to the board, the position of the pawn is derived.

Pawns of a particular pawn category, e.g. all red pawns, may comprise identical patterns for indicating the category which the pawn belongs to.

In a further improved embodiment the pattern is rotation asymmetric. When the pattern is not rotation symmetric, the orientation of the pawn relative to the board can be determined because each possible orientation of the pawn on the board surface results in a different configuration of the electrode contacts on the board surface.

In another embodiment, the pawn comprises a switch for either disabling or enabling the conducting of the electrical signal between said one of the triggerable sub-parts and the board surface. Such a pawn may be in two or more different states. In a first state another set of actions is provided to the user to choose from than in a second state. For example, a pawn may be provided for a board game with an offensive state, allowing the user to choose from "hit" and "kick" and with a defensive state, allowing the user to choose from "shield" and "run".

In another embodiment, the pawn comprises an electronic circuit, which electronic circuit comprises an input coupled to the at least two triggerable sub-parts, and an output for providing the first and the second trigger signal to the communication means.

With such a pawn the integrated circuit detects when a sub part is touched and thereupon generates a trigger signal. The trigger signal comprises information about which sub-part is touched and is communicated to the board via, for example, an electrode making contact with a conductive part of the board surface. When this information is encoded in the trigger signal, one electrode may be used for communicating different trigger signals to the board. Instead of an electrode wireless communication may be used for communicating the trigger signal to the board. The wireless communication circuit may use, for example, radio waves, such as Bluetooth, or infrared communication.

An embodiment of the system according to the invention comprises at least one, but preferably a plurality of pawns as described above and a board comprising presentation means for presenting a situation to the user, receiving means for receiving the first and the second trigger signal, and a processor which comprises a processor input and a processor output. The processor input is coupled to the receiving means. The processor output is coupled to the presentation means for changing the situation in response to the first and the second trigger signal.

The presentation means which may, for example, include an LCD screen or a speaker, provides information about relevant aspects of the situation, for example a game situation. The situation is changed by actions of the user and the actions of the user may be influenced by the information provided by the presentation means. When a user touches one of the triggerable sub-parts and the communication s communicate the corresponding trigger signal to the board, this trigger signal is received by the receiving means of the board and passed on to the input of the processor. The processor calculates the new situation from the present situation and the trigger signal. The trigger signal corresponds to a function associated with the pawn. The function is selected when a user touches a specific sub-part of that pawn. The new situation is determined by the processor and provided to the presentation means via the processor output. The new situation is presented to the user by the presentation means.

In another embodiment of the system according to the invention the pawn comprises a support surface for supporting the pawn on a board surface of the board. The communication means comprises at least one electrode, extending from an electrode contact at the support surface to one of the triggerable sub-parts, and the electrode contacts at the support surface form a geometrical pattern for identifying the pawn. The processor of the board is arranged for recognizing the geometrical pattern.

Because the geometrical pattern identifies the pawn, it is possible to detect the presence of a pawn by detecting the presence of the pattern on the board surface. From the position of the pattern relative to the board, the position of the contact surface is determined. From the positions of the electrode contacts relative to the board, the orientation of the contact surface is determined.

These and other aspects of the invention are apparent from and will be elucidated with reference to the embodiments described hereinafter.

BRIEF DESCRIPTION OF THE DRAWINGS

In the drawings:

FIG. 1*a* shows a side view of an exemplary embodiment of a pawn 10 according to the invention. The pawn 10 comprises an insulating body 13 and two electrically conductive triggerable sub-parts 11 and 12. FIG. 1*b* shows a bottom view of this pawn 10. The pawn 10 comprises a contact surface 10*a* for supporting the pawn on a board surface of the board. The contact surface 10*a* comprises two electrode contacts 11*a* and 12*a*. The triggerable sub-parts 11 and 12 are coupled to their respective electrode contacts 11*a* and 12*a* by an electrode. The electrode that couples the triggerable sub-part 11 on top of the pawn 10 to the central electrode contact 11*a* is buried in the mass of the pawn 10. This electrode is therefore well protected against damaging. The electrode that couples the triggerable sub-part 12 on the side of the pawn 10 to the outer electrode contact 12*a* runs along the surface of the pawn 10, which provides for a large triggerable area.

The pawn 10 may have any possible shape and may comprise any number of triggerable sub parts. The electrodes can be made of bulk material wiring, or by conductive material like Indium Tin Oxide (ITO), copper, another metal or comparable materials, that offer transparent electrodes that can be structured in thin films. Alternatively, conducting polymers or carbon loaded materials may be used.

In alternative embodiments of a pawn 10 according to the invention, the triggerable sub-parts 11 and 12 are coupled to an input of an electronic circuit which may be buried in the mass of the pawn 10. When a triggerable sub-part 11, 12 is touched, the electronic circuit creates a trigger signal, which trigger signal comprises information about which triggerable sub-part 11, 12 was touched. The trigger signal may further comprise other information, such as how long the triggerable sub-part 11, 12 was touched, the time at which the triggerable sub-part 11, 12 was touched or an identification of the pawn 10 which the triggerable sub-part 11, 12 is a part of. When the information about which sub-part 11, 12 was touched is encoded in the trigger signal, only one electrode is required for communicating the trigger signal to the board. Instead of via an electrode, the trigger signal may also be communicated to the board using other communication means. For example, wireless communication means, such as radio wave (e.g. Bluetooth) or infrared communication may be used for communicating the trigger signal to the board. It is an advantage of the use of electrodes for the communication that, the position of a pawn can be derived from the position of the contact with the board. In a wireless signal, position information has to be included or additional means are to be used for enabling communication of the position of a pawn.

Figure 2:
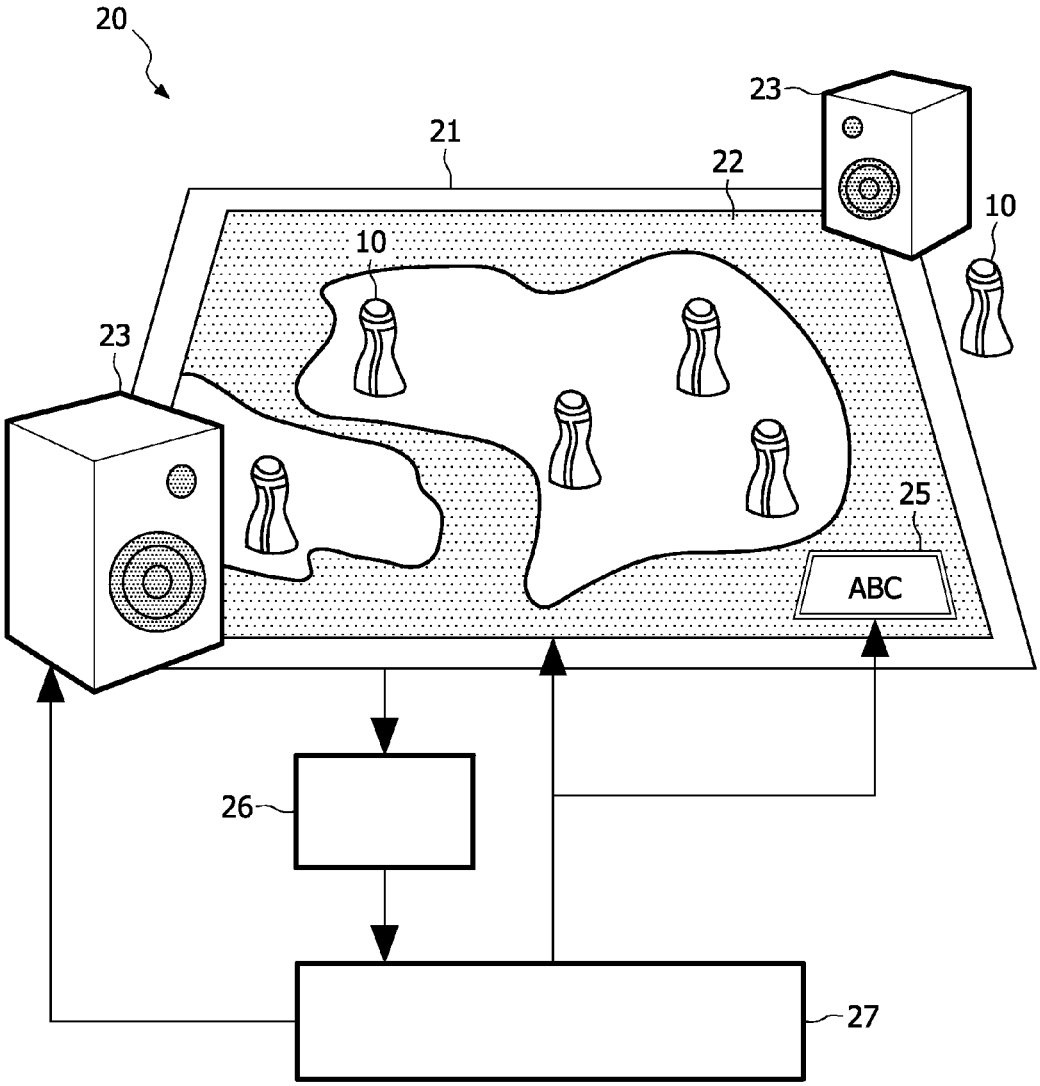

FIG. 2 schematically shows a system 20 according to the invention. The system 20 comprises a game board 21 and a set of pawns 10 as described above. The game board 21 comprises a board surface 22 whereon the game is played. The board surface 22 may show a permanent layout according to the rules of a board game which the game board 21 is made for. Possibly, the board surface 22 comprises parts of which the appearance changes during the progress of the game. Preferably the board surface 22 is a surface of an LCD-screen or other type of monitor, which makes it possible to display an unlimited amount of different layouts on the board surface 22.

On such a game board 21 an unlimited amount of different board games may be played. The layout of the board surface 22 may also change during the game for indicating a change of the game situation. Changes of the game situation may also be indicated by a sound from the speakers 23, by a text or score displayed on a text display 25 or by any other means capable of providing information. During the game, pawns 10 may be placed on or taken from the board surface 22 or may be moved from one position on the board surface 22 to another.

The game board 21 further comprises a receiving unit 26 for receiving trigger signals from the pawns 10. The receiving unit 26 therefore has to communicate with a communication unit of the pawn 10. If, for example, the trigger signals are provided via the electrode contacts 11*a*, 12*a* at the contact surface of the pawn 10, the receiving unit 26 has to be electrically coupled to the board surface 22. If the trigger signals are provided via Bluetooth or infrared communication, the receiving unit 26 has to comprise a Bluetooth or infrared receiver respectively. Alternatively, the receiving unit 26 is connected to an array of electrodes for localization of contacts with the pawn. A processor 27 in the game board 21 has a processor input coupled to the receiving unit 26 and a processor output coupled to a device, such as the LCD-screen, the text display 25 and/or the speakers 23, for presenting the game situation. When a pawn 10 is touched, the processor 27 determines the new game situation which is changed by the touching of one of the triggerable sub-parts 11, 12. The new game situation is determined from the previous game situation and the received trigger signal. The processor 27 sends instructions to the LCD-screen, text display 25 and/or speakers 23 for enabling the presentation of the changed situation.

Figure 3:
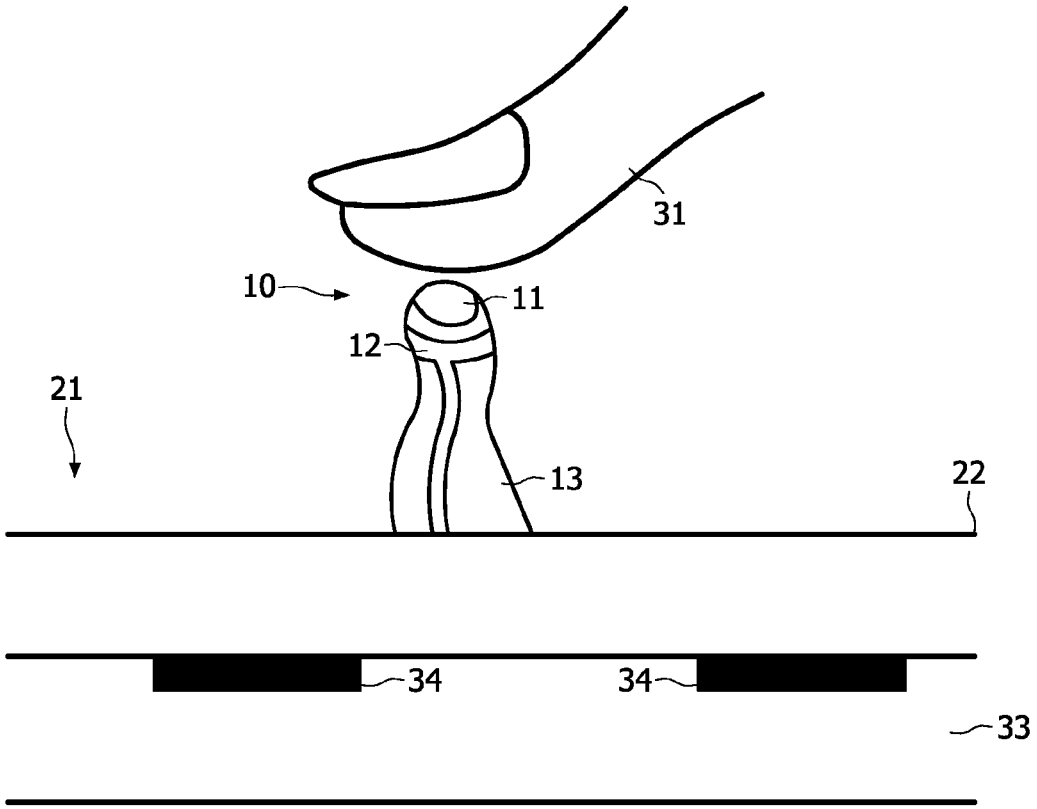
FIG. 3 shows a pawn and part of a board according to the invention.

FIG. 3 shows a pawn 10 and part of a board according to the invention. FIG. 3 further shows a user's finger, touching the triggerable sub-part 11 on top of the pawn 10. Upon the touching of triggerable sub-part 11, the finger 31 brings the triggerable sub-part 11, the electrode and the electrode contact 11*a* to the same potential as the body of the user. Where the electrode contact 11*a* contacts the board surface 22, the variation of the potential is detected by the elements 33 which are embedded in the board 21. The embedding of an array of elements 33 in the board allows localizing the point of contact with high accuracy.

Figure 1A:
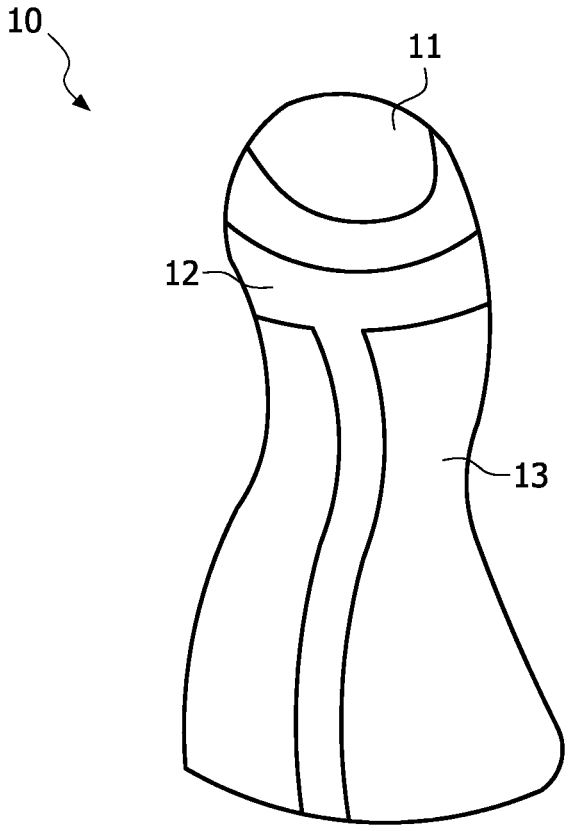
FIG. 1*a* shows a side view of an exemplary embodiment of a pawn according to the invention.
Figure 1B:
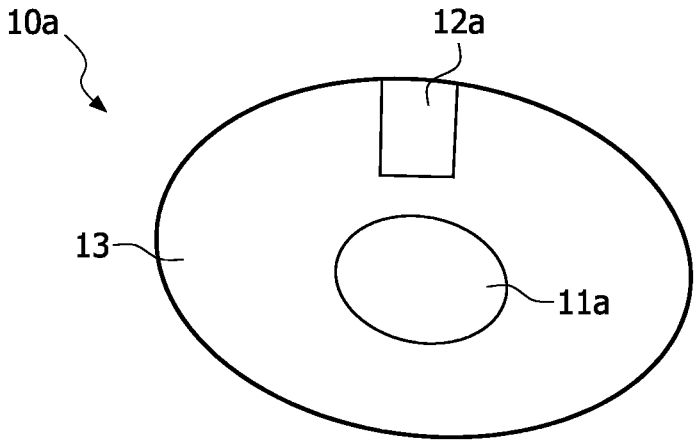
FIG. 1*b* shows a bottom view of an exemplary embodiment of a pawn according to the invention, FIG. 2 schematically shows a system according to the invention.
Figure 4:
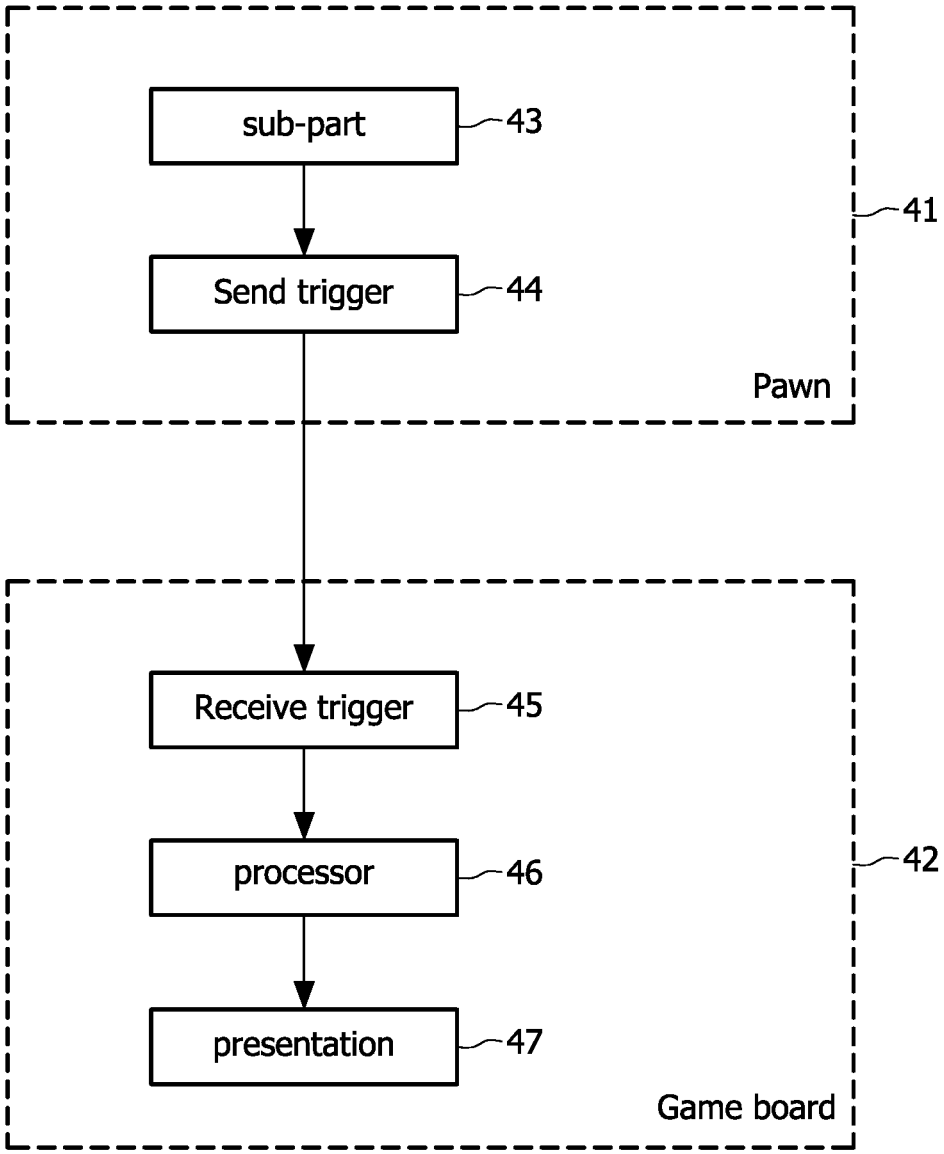
FIG. 4 shows a flow diagram of a process which may be performed by the system according to the invention.

FIG. 4 shows a block diagram of the system according to the invention. The system comprises a board 42 and at least one pawn 41. The pawn 41 comprises at least two separate triggerable sub-parts, of which only one triggerable sub-part 43 is shown in FIG. 4. The triggerable sub-part 43 may be an electrically conductive contact, a pressure sensor, a heat sensor, a button or any other type of sensitive contact, capable of sensing a touch by a user. Preferably a touch can be detected regardless of how it is performed. The user may, for example, touch the triggerable sub-part 43 with bare fingers, with gloves on or with an electrically conductive or insulating pointing device. When the triggerable sub-part 43 is touched a trigger signal is provided, which corresponds to the touched sub-part 43. The trigger signal may, for example, be an electric signal, a light signal or a radio signal. Upon the touching of each separate triggerable sub-part a different trigger signal is provided. Therefore it will be possible for the board 42 to differentiate between the touching of different sub-parts. The difference between two signals may, for example, be obtained by providing frequency modulated or phase modulated radio signals, by providing electric currents of different magnitude or by providing identical signals via different paths. These and other techniques for providing different signals are well known in the art. For example, the pawn 10 in FIG. 1 comprises two electrode contacts 11*a* and 12*a* for providing possibly identical signals at different locations. From the location at which the signal is provided, it can be determined which sub-part has been touched. Different electric signals may, for example, also be provided by coupling two sub-parts to an electrode contact via resistors with different resistance values. The resistance value influences the magnitude of the current which results from the touching of one of the sub-parts.

The pawn 41 comprises a communication unit 44 for communicating the trigger signal to the board 42 when the triggerable sub-part 43 is touched. For the communication, electrodes may be used, as described above with reference to FIGS. 1 and 3. Alternatively, wireless communication techniques, such as Bluetooth or infrared communication may be used. The pawn 41 may comprise an electronic circuit for creating and/or processing the trigger signals and for sending the trigger signals to the board 42. The electronic circuit may convert the original signals coming from the triggerable sub-parts to other signals for sending to the board 42. The converted signals may also comprise additional information like, for example, an identity code of the pawn or a time at which the touch is detected. For enabling wireless communication, the pawn 41 comprises a power unit or a unit for receiving power from an external power source.

The board 42 comprises a receiving unit 45 for receiving the trigger signal from the communication unit 44. The receiving unit 45 and the processor may be integrated in the game board 42 or may be present in a separate unit which is coupled to the board 42.

When the communication unit 44 uses wireless communication, the receiving unit 45 may also be part of or coupled to a personal computer which is coupled to the board 42. In this event a processor of the personal computer may be used for processing the trigger signal and changing the situation and an output of the personal computer is coupled to the board 42 for providing the changed situation to the presentation means 47 for presenting the situation to the user.

Figure 5A:
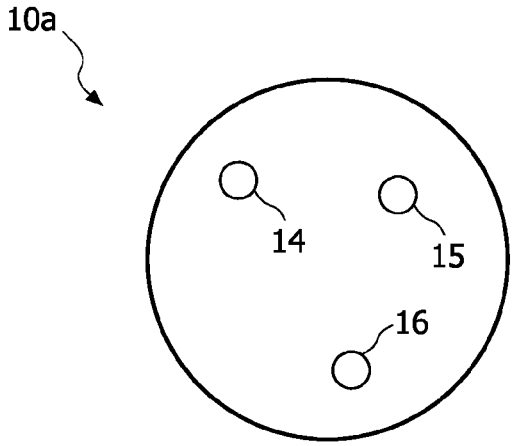
FIGS. 5*a*, 5*b* and 5*c* show three orientations of a pawn comprising a pattern of electrode contacts in the contact surface.
Figure 5B:
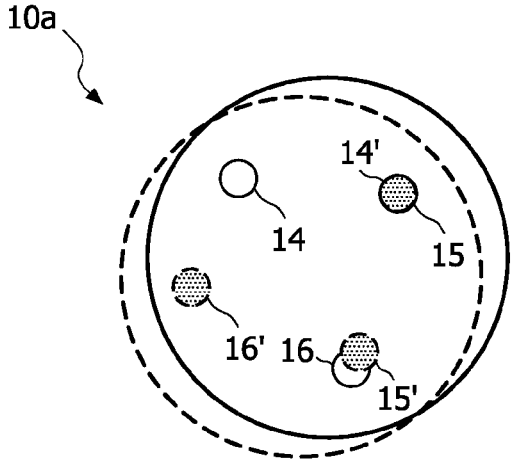
Figure 5C:
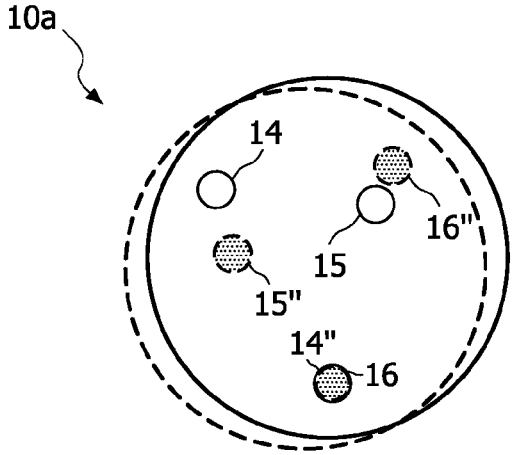

FIGS. 5*a*, 5*b* and 5*c* show three orientations of a pawn comprising a pattern of electrode contacts 14, 15, 16 at the contact surface 10*a*. The pattern is rotation asymmetric. In FIG. 5*a* one random orientation of the pawn is shown. FIGS. 5*b* and 5*c* show that it is not possible to rotate and/or replace the pawn without changing the orientation of the pattern of electrodes 14, 15, 16 relative to the board. When the positions of the three electrodes 14, 15, 16 are known, the orientation of the pawn can be determined.

Figure 6A:
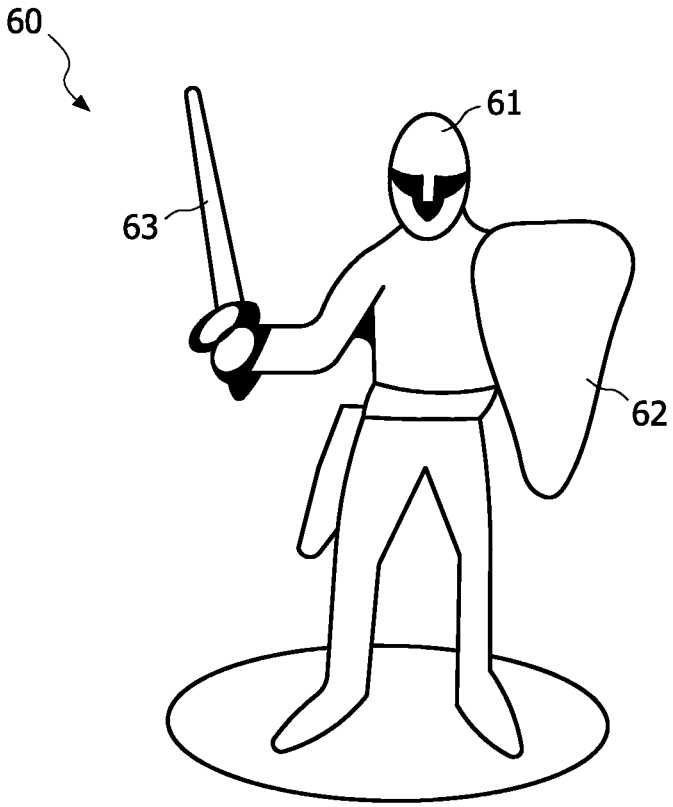
FIG. 6*a* shows a front view of an exemplary embodiment of a pawn according to the invention.
Figure 6B:
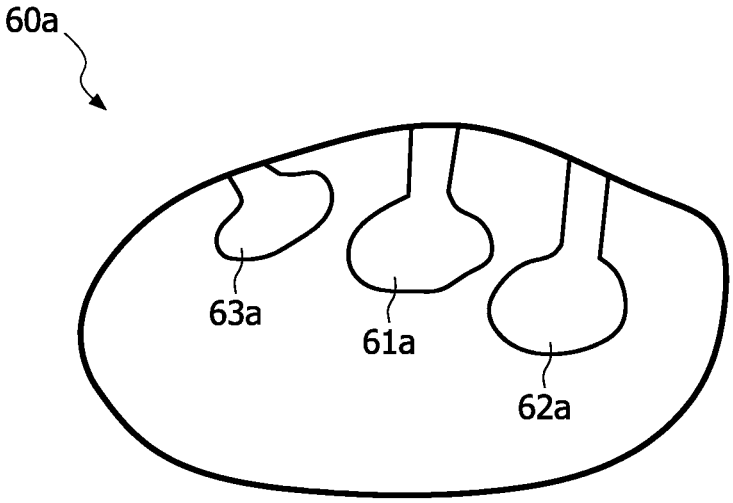
FIG. 6*b* shows a bottom view of an exemplary embodiment of a pawn according to the invention.

FIG. 6*a* shows a front view of an exemplary embodiment of a pawn 60 according to the invention. This pawn 60 is preferably used for a board game and represents a warrior. The pawn 60 comprises three triggerable sub-parts with the shape of a head 61, a shield 62 or a sword 63. These triggerable sub-parts are coupled to their respective electrode contacts 61*a*, 62*a*, 63*a*. A user may, for example, choose to let the character attack an unfriendly character of another player by touching the sword 63, fend off an attack by touching the shield 62 or try to negotiate by touching the helmet 61. FIG. 6*b* shows a bottom view of the exemplary embodiment of the pawn 60 shown in FIG. 6*a*. The bottom view shows a possible arrangement of the electrode contacts 61*a*, 62*a* and 63*a*.

Figure 7:
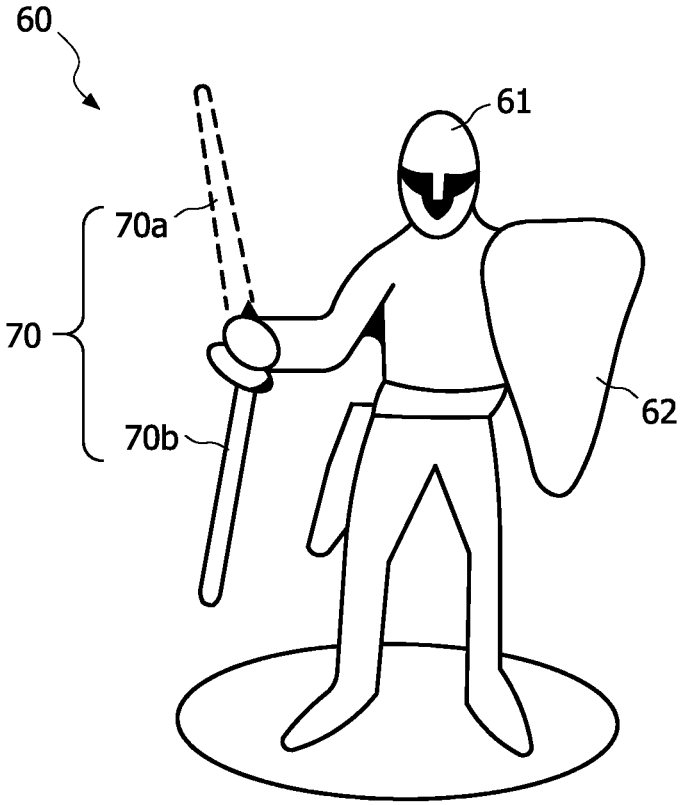
FIG. 7 shows an exemplary embodiment of a pawn according to the invention, comprising a switch.

FIG. 7 shows an exemplary embodiment of a pawn 60 according to the invention, comprising a switch 70. The switch 70 has two states: 'sword up' 70*a* and 'sword down' 70*b*. When the switch 70 is in a 'sword up'-state the user may, for example, choose to let the character attack an unfriendly character of another player by touching the sword 70*a*, fend off an attack by touching the shield 62 or try to negotiate by touching the helmet 61. When the switch 70 is in a 'sword-down'-state 70*b*, the attack option is disabled and the user should choose between negotiating and shielding. The disabling may, for example be obtained by interrupting the electrode which extends from the triggerable sub-part 70 to the electrode contact at the support surface of the pawn 60.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A pawn for use on a board and comprising:

a support surface for supporting the pawn on a board surface of the board;

at least two separate triggerable sub-parts for, upon a touch of each respective one of the at least two separate triggerable sub-parts by a user, respectively providing a first and a second electrical trigger signal, the first and the second electrical trigger signal being mutually distinguishable; and a communication unit communicating the first and the second electrical trigger signal to the board, the communication unit comprising at least one electrode, extending from an electrode contact at the support surface to one of the triggerable sub-parts, wherein the pawn is configured to perform a plurality of pawn actions, the first and the second electrical trigger signals each represent distinct ones of the plurality of pawn actions, and wherein a set of less than the entirety of the plurality of pawn actions are available based on a predetermined state of the pawn.

2. A pawn as claimed in claim 1, wherein a plurality of electrode contacts at the support surface form a geometrical pattern for identifying the pawn.

3. A pawn as claimed in claim 1, wherein the geometrical pattern is rotationally asymmetric.

4. A pawn as claimed in claim 1, further comprising a switch for either disabling or enabling the conducting of the electrical signal between said one of the triggerable sub-parts and the board surface.

5. A pawn as claimed in claim 1, further comprising an electronic circuit, which electronic circuit comprises:

an input coupled to the at least two triggerable sub-parts, and an output for providing the first and the second trigger signal to the communication unit.

6. A pawn as claimed in claim 5 wherein the communication unit comprise wireless communication means for communicating the first and the second trigger signal to the board.

7. A pawn as claimed in claim 1 wherein a third trigger signal is provided upon a simultaneous touch of both triggerable sub-parts by the user, the third trigger signal being distinguishable from the first and the second trigger signal.

8. A system comprising:

a board; and at least one pawn, the pawn comprising:

at least two separate triggerable sub-parts for, upon a touch of each respective one of the at least two separate triggerable sub-parts by a user, respectively providing a first and a second electrical trigger signal, the first and the second electrical trigger signal being mutually distinguishable, a communication unit for communicating the first and the second electrical trigger signal to the board, the board comprising:

presentation means for presenting a situation to the user, receiving means for receiving the first and the second electrical trigger signal, and a processor comprising a processor input and a processor output, the processor input being coupled to the receiving means, the processor output being coupled to the presentation means for changing the situation in response to the first and the second electrical trigger signal, wherein the pawn is configured to perform a plurality of pawn actions, the first and the second electrical trigger signals each represent distinct ones of the plurality of pawn actions, and wherein a set of less than the entirety of the plurality of pawn actions are available based on a predetermined state of the pawn.

9. A system as claimed in claim 8, wherein the board is a game board and the situation is a game situation.

10. A system as claimed in claim 8 wherein the pawn comprises a support surface for supporting the pawn on a board surface of the board, the communication unit comprising at least one electrode, extending from an electrode contact at the support surface to one of the triggerable sub-parts, the electrode contacts at the support surface forming a geometrical pattern for identifying the pawn, and the processor being operative to recognize the geometrical pattern.

11. A system as claimed in claim 10, wherein the processor is further operative to determine a position of the pattern relative to the board.

12. A system as claimed in claim 10, wherein the processor is further operative to determine an orientation of the pattern relative to the board.

* * * * *